US010582777B2

(12) United States Patent
Leng

(10) Patent No.: US 10,582,777 B2
(45) Date of Patent: Mar. 10, 2020

(54) SPRING BED WITH QUICK ASSEMBLY AND DISASSEMBLY

(71) Applicant: GRANDI-ONE FURNITURE CO., LTD., Xiamen, Fujian (CN)

(72) Inventor: Luhao Leng, Fujian (CN)

(73) Assignee: Grandi-One Furniture Co., Ltd., Xiamen, Fujian (CN)

( * ) Notice: Subject to any disclaimer, the term of this patent is extended or adjusted under 35 U.S.C. 154(b) by 254 days.

(21) Appl. No.: 15/549,938

(22) PCT Filed: Feb. 22, 2016

(86) PCT No.: PCT/CN2016/074235

§ 371 (c)(1),
(2) Date: Aug. 9, 2017

(87) PCT Pub. No.: WO2016/134645

PCT Pub. Date: Sep. 1, 2016

(65) Prior Publication Data

US 2018/0027976 A1 Feb. 1, 2018

(30) Foreign Application Priority Data

Feb. 28, 2015 (CN) ..... 2015 2 0119007 U
Feb. 28, 2015 (CN) ..... 2015 2 0119023 U
(Continued)

(51) Int. Cl.
*A47C 23/00* (2006.01)
*A47C 23/043* (2006.01)
(Continued)

(52) U.S. Cl.
CPC ..... *A47C 23/005* (2013.01); *A47C 17/645* (2013.01); *A47C 17/70* (2013.01);
(Continued)

(58) Field of Classification Search
CPC ... A47C 19/005; A47C 19/122; A47C 17/645; A47C 17/70; A47C 23/005;
(Continued)

(56) References Cited

U.S. PATENT DOCUMENTS 1,338,806 A * 5/1920 Young ..... A47C 23/05 5/264.1
1,417,253 A * 5/1922 Kibler, Jr. ..... A47C 17/70 5/119
(Continued)

FOREIGN PATENT DOCUMENTS

CN 2054283 U 3/1990
CN 201468618 U 5/2010
(Continued)

*Primary Examiner* — David R Hare
(74) *Attorney, Agent, or Firm* — Cooper Legal Group, LLC

(57) ABSTRACT

A spring bed with quick assembly and disassembly includes two cross bars, a plurality of vertical bars, a plurality of springs, and a plurality of fixing bases. The two cross bars and the vertical bars are parallel arranged with spacing. The two ends of the vertical bars are detachably assembled to the two cross bars. Each vertical bar is disposed with a plurality of fixing bases. The springs are detachably assembled to the fixing bases. Two ends of the vertical bar are detachably connected to the two cross bars.

22 Claims, 11 Drawing Sheets

(30) Foreign Application Priority Data

Feb. 28, 2015 (CN) ..... 2015 2 0119024 U
Feb. 28, 2015 (CN) ..... 2015 2 0119051 U

(51) Int. Cl.

| | |
|---|---|
| ***A47C 19/12*** | (2006.01) |
| ***A47C 17/70*** | (2006.01) |
| ***A47C 19/00*** | (2006.01) |
| ***A47C 17/64*** | (2006.01) |
| ***A47C 23/053*** | (2006.01) |
| ***A47C 27/00*** | (2006.01) |

(52) U.S. Cl.
CPC ..... *A47C 19/005* (2013.01); *A47C 19/122* (2013.01); *A47C 23/043* (2013.01); *A47C 23/0507* (2013.01); *A47C 27/00* (2013.01)

(58) Field of Classification Search
CPC ... A47C 23/043; A47C 23/05; A47C 23/0507; A47C 27/00; A47C 27/001
See application file for complete search history.

(56) References Cited

U.S. PATENT DOCUMENTS

| | | | | | |
|---|---|---|---|---|---|
| 1,718,522 | A * | 6/1929 | Brandreth | A47C 23/05 | 5/264.1 |
| 2,021,506 | A * | 11/1935 | Hamilton, Sr. | D06F 83/00 | 38/66 |
| 2,332,042 | A * | 10/1943 | Asaro | F16F 1/122 | 5/264.1 |
| 2,589,579 | A * | 3/1952 | Slayen | A47C 27/001 | 5/722 |
| 2,841,209 | A * | 7/1958 | Wetzler | A47C 23/05 | 267/100 |
| 2,843,857 | A * | 7/1958 | Wetzler | A47C 7/347 | 5/264.1 |
| 3,134,987 | A * | 6/1964 | Bertram | A47C 17/645 | 5/111 |
| 3,882,557 | A * | 5/1975 | Stehlik | A47C 17/70 | 5/114 |
| 4,038,711 | A * | 8/1977 | Golembeck | A47C 23/05 | 5/263 |
| 4,095,298 | A * | 6/1978 | Pringle | A47C 23/05 | 5/263 |
| 4,985,952 | A * | 1/1991 | Edelson | A47C 27/001 | 150/158 |
| 6,564,402 | B1 | 5/2003 | Lin | | |
| 6,618,883 | B2 * | 9/2003 | Angland | A47C 17/04 | 5/12.1 |
| 6,869,067 | B2 * | 3/2005 | Duval | F16F 1/126 | 267/179 |
| 9,586,453 | B2 * | 3/2017 | Mizukoshi | F16F 1/122 | |
| 2014/0250593 | A1 | 9/2014 | Kim et al. | | |

FOREIGN PATENT DOCUMENTS

| | | | | |
|---|---|---|---|---|
| CN | 204091466 U | 1/2015 | | |
| CN | 204580594 U | 8/2015 | | |
| CN | 204580617 U | 8/2015 | | |
| CN | 204580618 U | 8/2015 | | |
| CN | 204580619 U | 8/2015 | | |
| GB | 389191 A * | 3/1933 | | A47C 23/05 |

* cited by examiner

SPRING BED WITH QUICK ASSEMBLY AND DISASSEMBLY

FIELD OF THE INVENTION

The present invention relates to a spring bed with quick assembly and disassembly.

BACKGROUND OF THE INVENTION

With the improvement of people's life quality, camping, self-driving travel and other outdoor leisure activities are involved in people's life. Usually, people sleep on a mattress or in a sleeping bag in a camping. As the ground is hard and unsmooth, it sleeps uncomfortable. In addition, the ground moisture is heavy, making people easy to catch cold and feel backache, particularly to people with bad cervical and lumber vertebra. If it rains at midnight, people have nowhere to hide.

Therefore, there is a spring bed convenient to carry. The spring bed can be unfolded when unused and be put to the trunk. However, the spring beds collapse after long time's use, making it uncomfortable. The unfolded spring bed is shortened but still has a long width, still occupying large space that it can not be put in a trunk, making it inconvenient to carry.

SUMMARY OF THE INVENTION

The present invention is provided with a spring bed with quick assembly and disassembly. The technical proposal of the present invention is that:

A spring bed with quick assembly and disassembly, comprising two cross bars parallel arranged and a plurality of vertical bars parallel arranged with space, wherein two ends of the vertical bar are respectively detachably assembled to the two cross bars; a plurality of springs are further provided, the vertical bar is disposed with a plurality of fixing bases spaced arranged along the length direction, the springs are detachably assembled to the fixing bases.

A spring bed with quick assembly and disassembly, comprising two cross bars parallel arranged and a plurality of vertical bars parallel arranged with space, two ends of the vertical bar are respectively detachably assembled to the two cross bars; the cross bar comprises a front section, a rear section and a central section connecting the front section and the rear section, the central section is rotatably or detachably inserted to the front section, the central section is rotatably or detachably inserted to the rear section.

Compared to the existing known technology, the present invention has advantages as follows:

1. Two ends of the vertical bar are detachably connected to the two cross bars, the vertical bars are detached for individual package. The spring bed is convenient to store and carry. In addition, the springs can greatly provide comfort, satisfying the consumers' needs.

2. The conical springs at two vertical bars can be embedded together in cross way when being packed, making the conical springs of one vertical bar embedded to the conical springs of another vertical bar, the vertical bars with the conical springs are compactly stacked, greatly reducing the package size, the conical springs needn't to be detached and assembled repeatedly.

3. The conical springs can screw and unscrew to the spiral grooves freely, the conical springs are assembled and disassembled conveniently and quickly. As the conical springs can be detached and be individually packed, efficiently reducing the package size of the spring bed.

4. The central section is rotatably connected or detachably inserted to the front section and the rear section, the cross bar can be detached or folded to be packed and be detached or folded when unused, thus shortening the length of the cross bars, being benefit for package and carrying.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
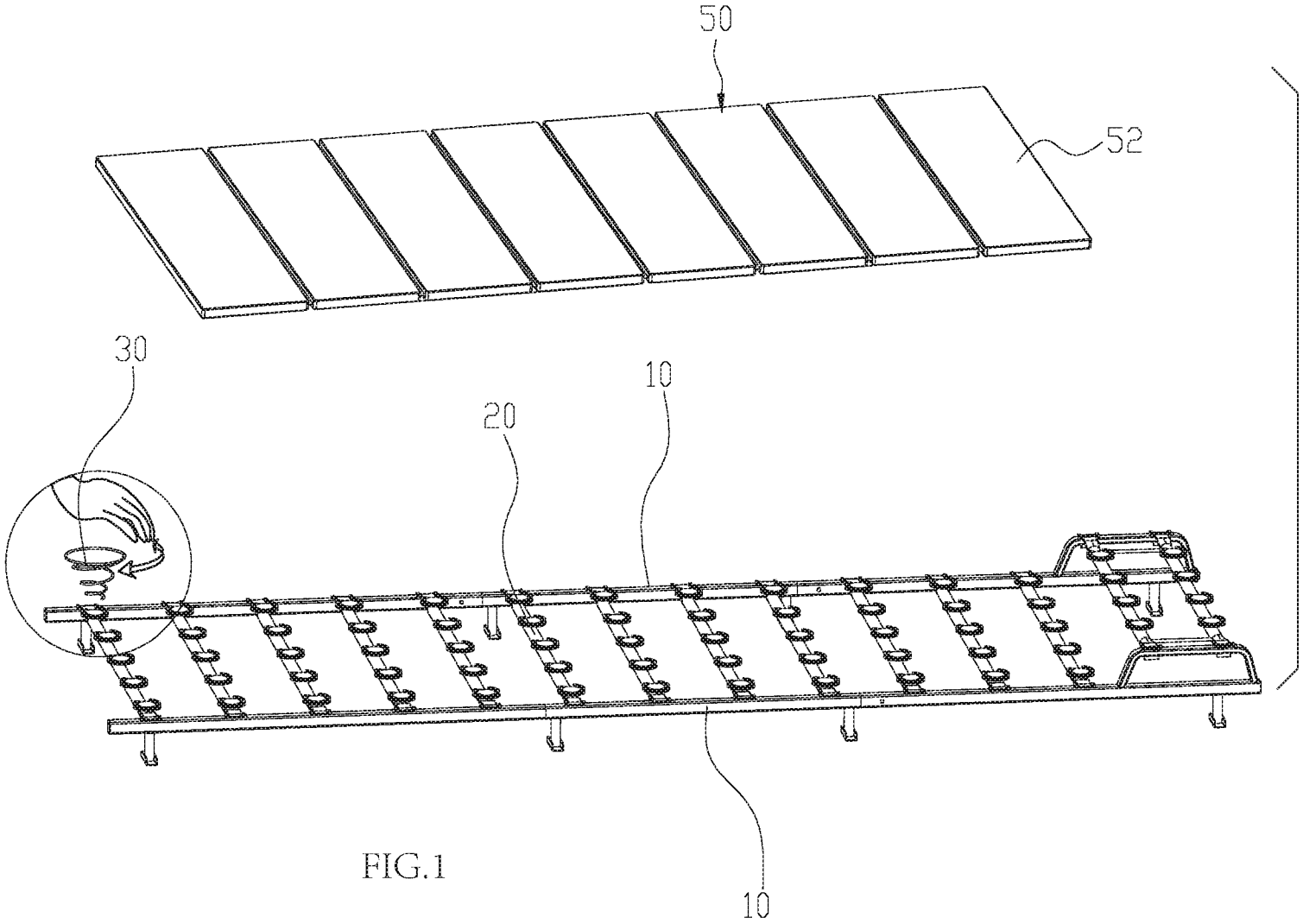
FIG. 1 illustrates a schematic diagram of a spring bed with quick assembly and disassembly of a first embodiment of the present invention.
Figure 2:
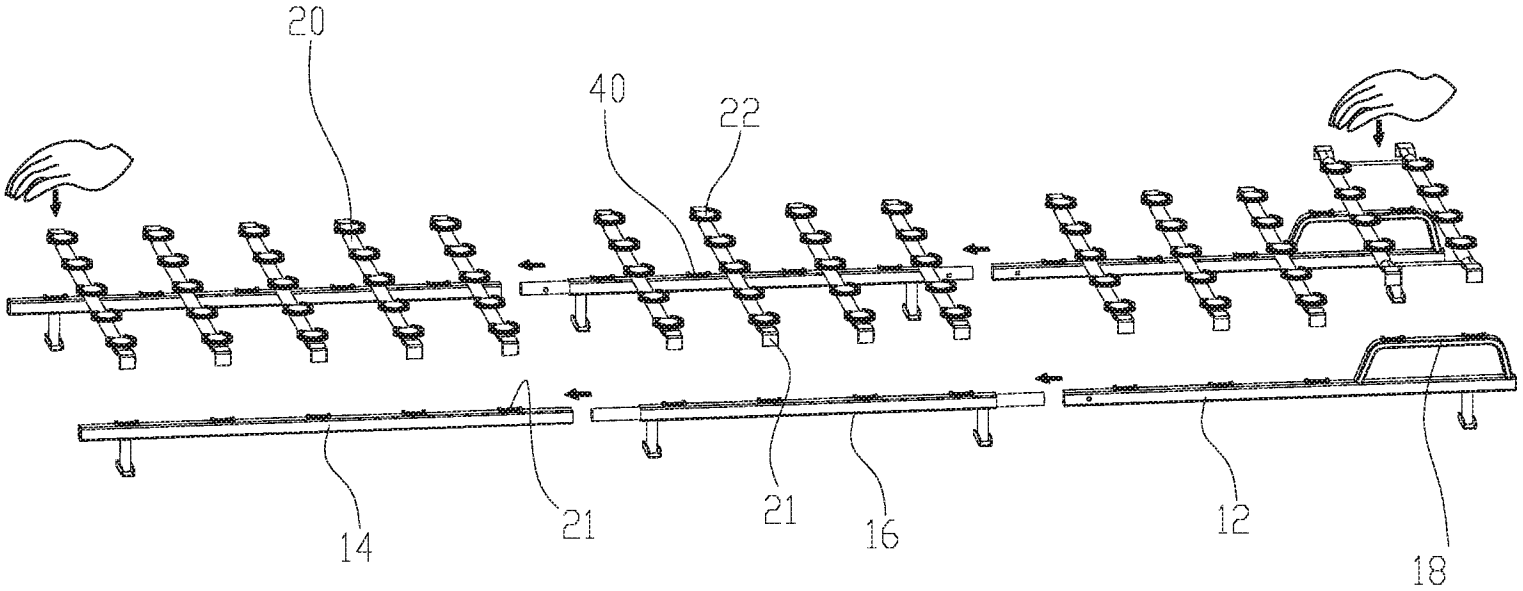
FIG. 2 illustrates a schematic diagram of a cross bar and a vertical bar of the spring bed of FIG. 1.
Figure 3:
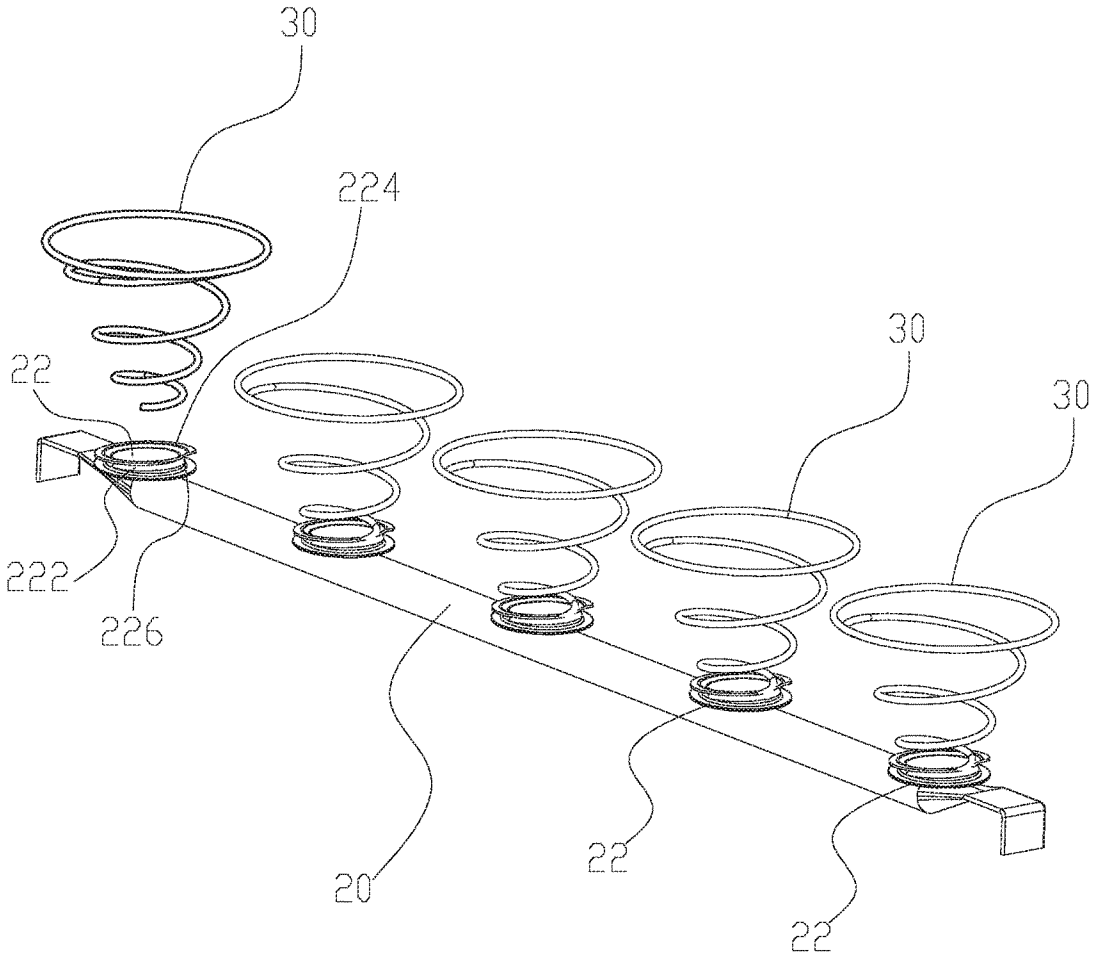
FIG. 3 illustrates a schematic diagram of the connecting of the springs and the vertical bar of the spring bed of FIG. 1.

Referring to FIGS. 1-3, a spring bed with quick assembly and disassembly comprises two cross bars 10 parallel arranged and a plurality of vertical bars 20 parallel arranged with space, two ends of the vertical bar 20 are respectively detachably assembled to the two cross bars 10; a plurality of springs 30 are further provided, the vertical bar 20 is disposed with a plurality of fixing bases 22 spaced arranged along the length direction, the springs 30 are detachably assembled to the fixing bases 22. The springs 30 are conical springs, the external surface of the fixing base 22 is formed with a spiral groove 222 corresponding to the conical spring, the fixing base 22 is formed with a protruding edge 224 on the spiral groove, the protruding edge 224 is disposed with an opening 226 connected to the spiral groove, one end of the conical spring 30 screws and unscrews out of the spiral groove through the opening 226 freely. Please refer to FIG. 4, preferred, the external edge of the protruding edge 224 turns down to form a flange 228.

Figure 4:
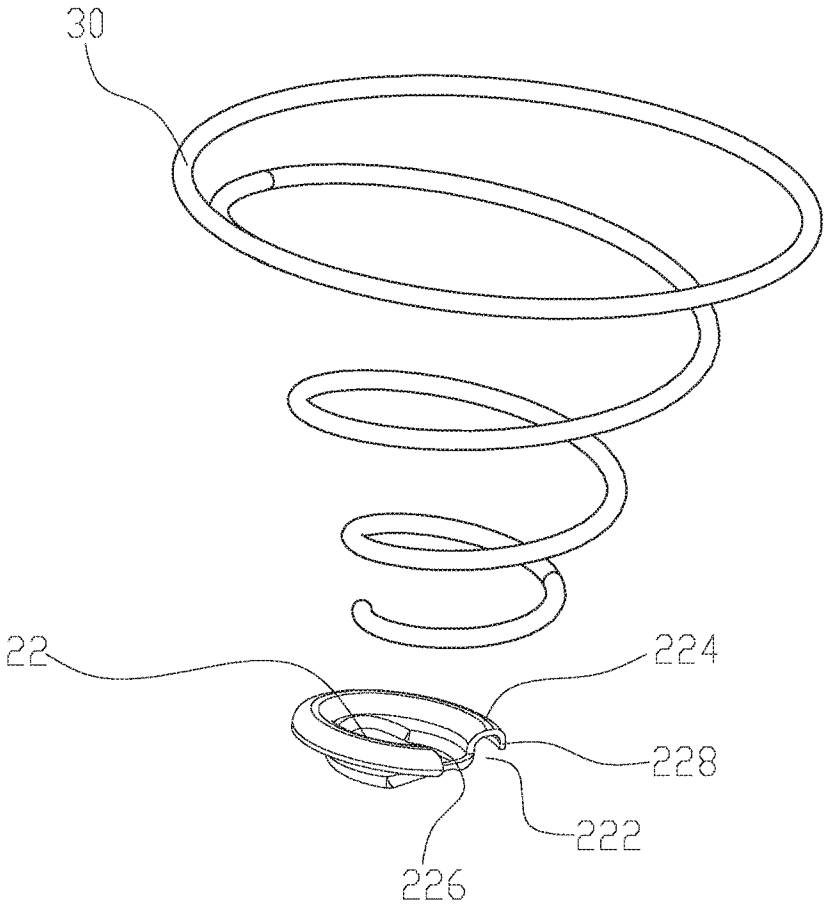
FIG. 4 illustrates a schematic diagram of a fixing base of the spring bed of FIG. 1.
Figure 5:
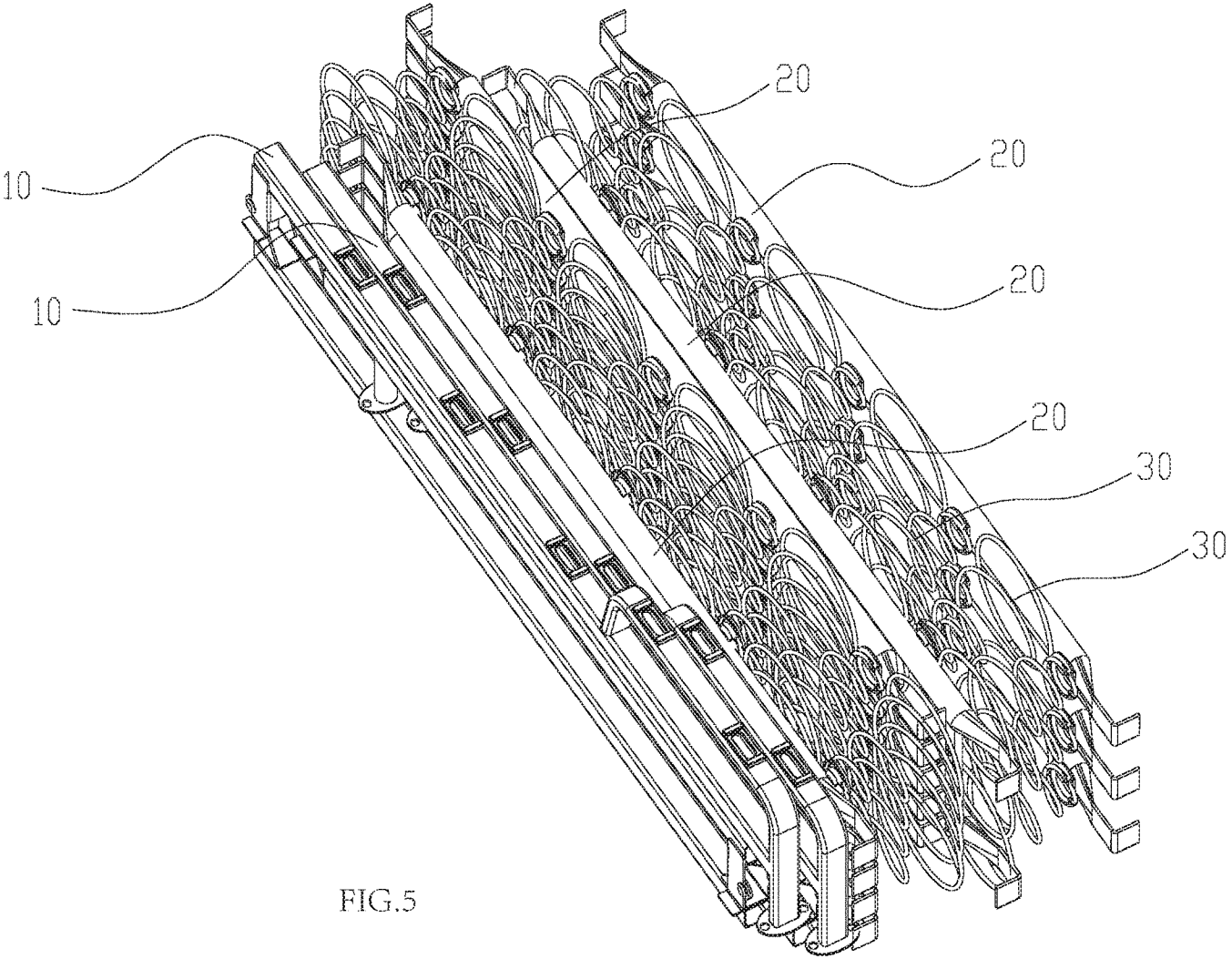
FIG. 5 illustrates a schematic diagram of the folded spring bed (without a mattress) of FIG. 1.
Figure 6:
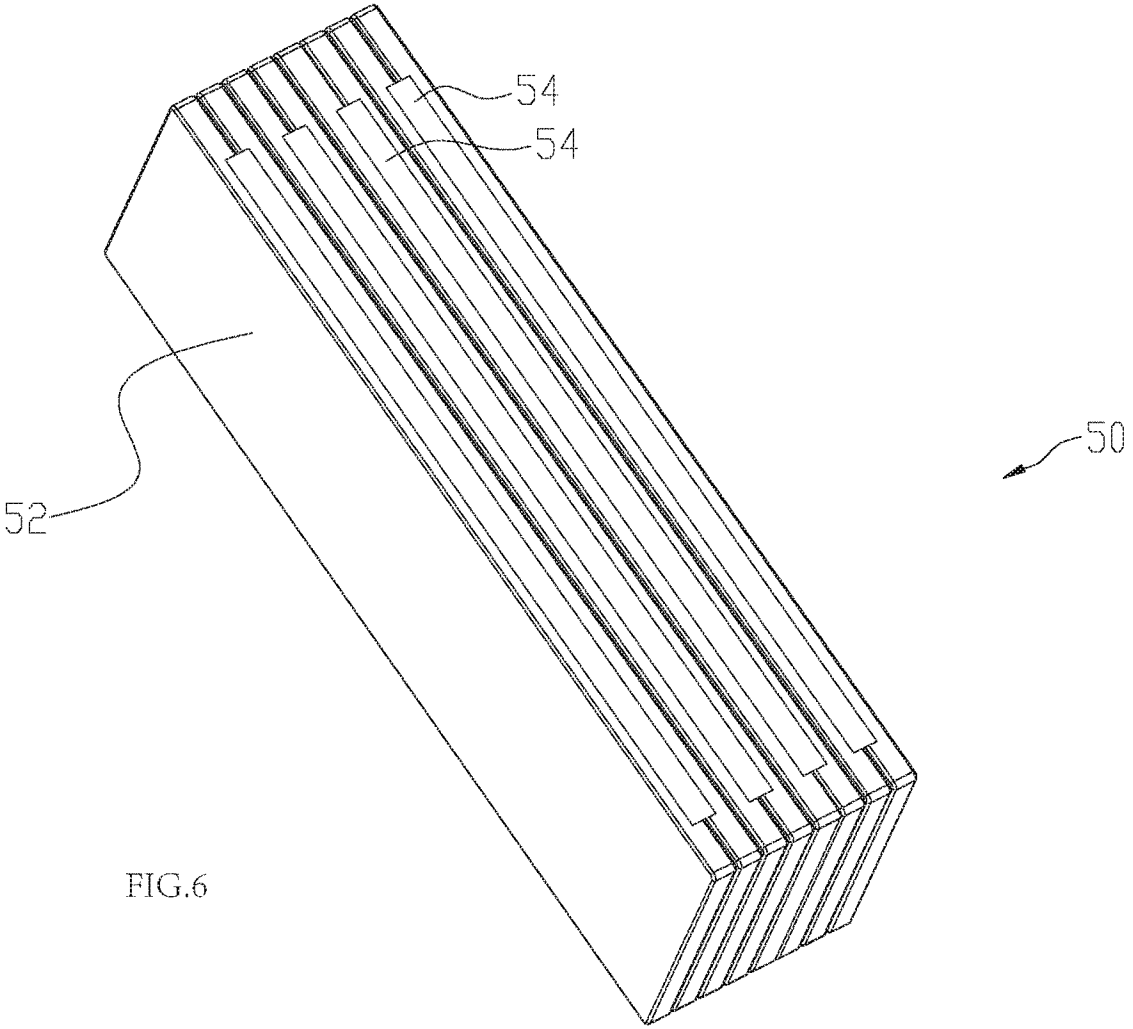
FIG. 6 illustrates a schematic diagram of a folded mattress of the spring bed of FIG. 1.

Please referring to FIG. 3 and FIG. 4, the conical spring 30 is disposed with a large end and a small end, the small end of the conical spring 30 is connected to the fixing base 22, the large end of the conical spring 30 is a closed ring. The fixing bases 22 are arranged with equal spaces in the vertical bar 20 along the length direction, referring to FIG. 5, the conical springs 30 of two vertical bars 20 are embedded together in crossing way or the conical springs 30 are detachable from the fixing bases 22 to stack together when being packed.

Referring to FIG. 2, the cross bar 10 comprises a front section 12, a rear section 14 and a central section 16 connecting the front section and the rear section, the cross bar 10 is a three-section structure, the central section 16 is rotatably or detachably inserted to the front section 12, the central section 16 is rotatably or detachably inserted to the rear section 14. Two ends of the central section 16 are respectively inserted to the front section 12 and the rear section 14. Two ends of the central section 16 are respectively disposed with an elastic block ball, the front section 12 and the rear section 14 are respectively disposed with a through hole, the elastic block ball is capable of embedding to the through hole. The cross bar 10 can be divided to three sections for package with the vertical bars 20 when being packed, in another case, the cross bars 10 can be detached for individually package.

Figure 7:
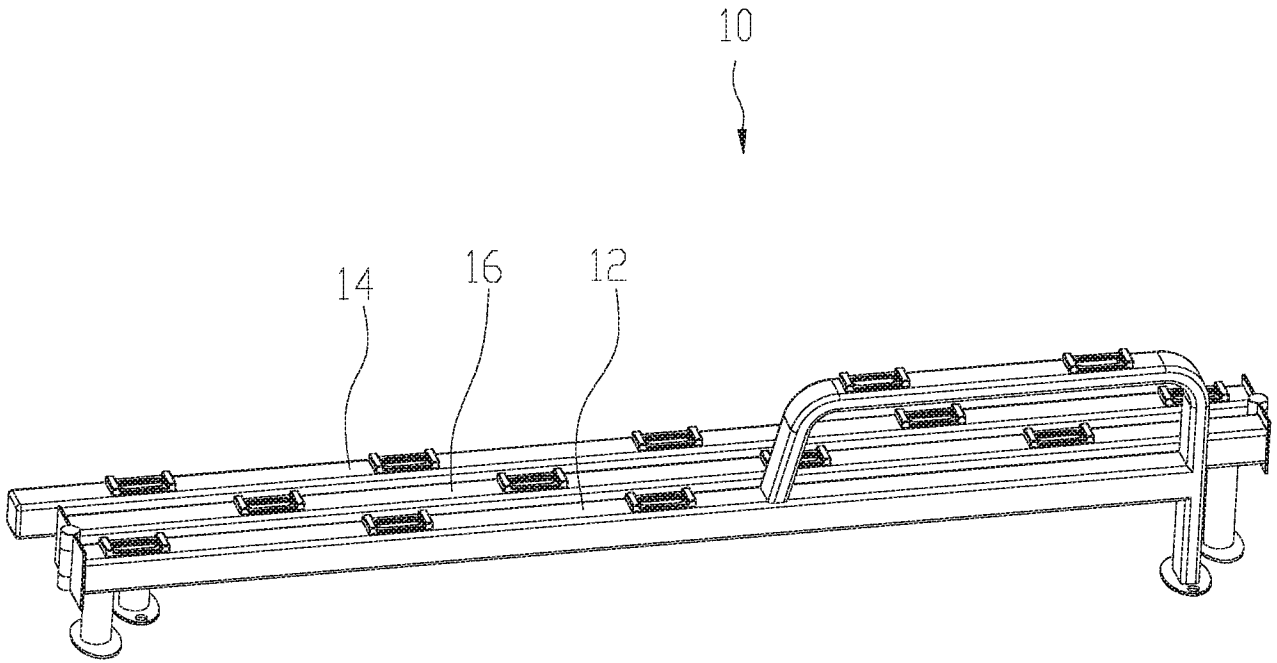
FIG. 7 illustrates a schematic diagram of a first kind of cross bar of the spring bed of FIG. 1.
Figure 8:
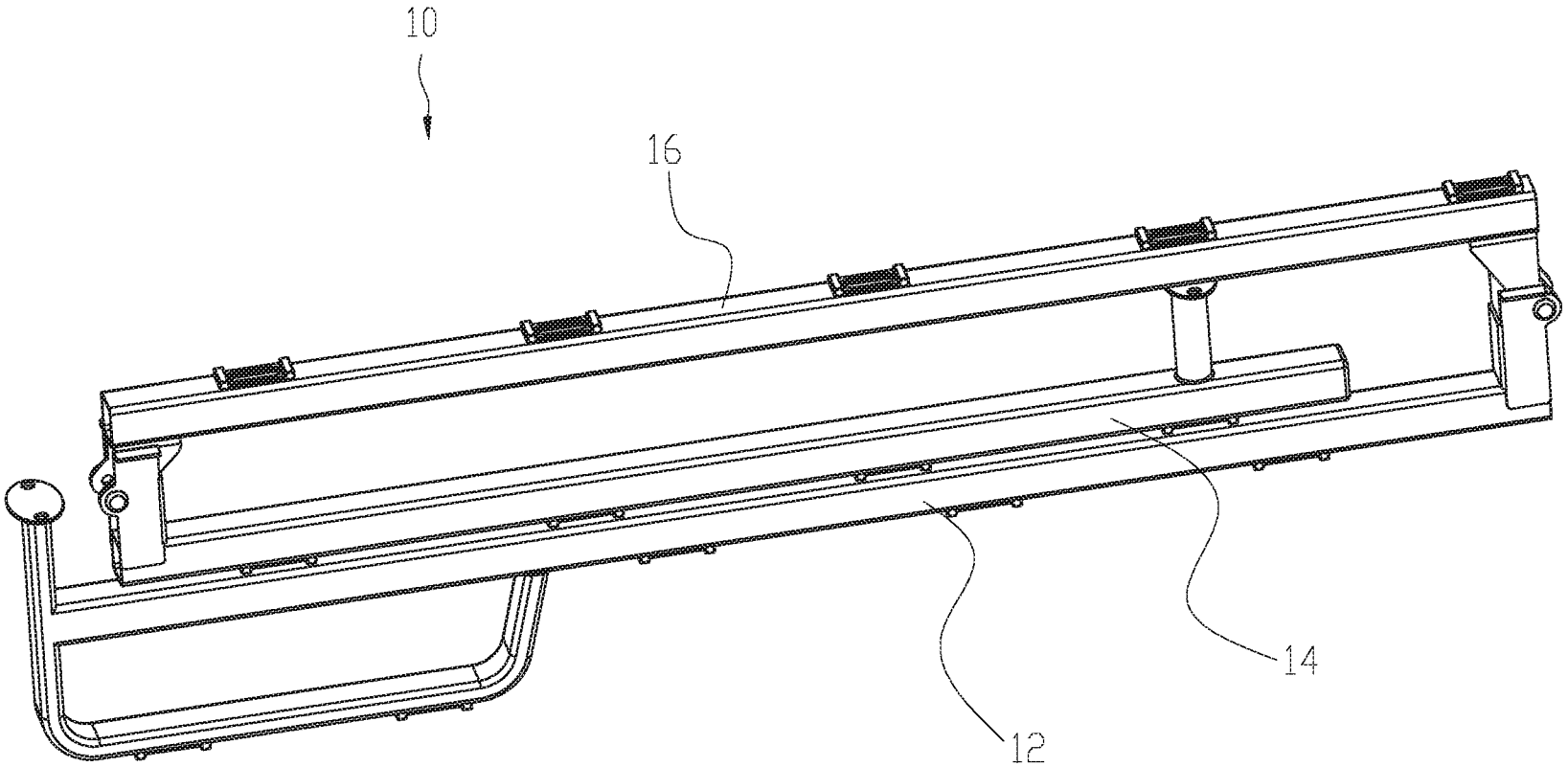
FIG. 8 illustrates a schematic diagram of a second kind of cross bar of the spring bed of FIG. 1.

Referring to FIG. 7 and FIG. 8, the central section 16 is rotatably connected to the front section 12, the central section 16 is rotatably connected to the rear section 14. The central section 16 is respectively connected to the front section 12 and the rear section 14 by a hinge; the front section 12 and the rear section 14 are folded to the two sides of the central section 16 when being folded. In another case, the central section 16 is respectively rotatably riveted to the front section 12 and the rear section 14; the front section 12, the rear section 14 and the central section 16 are stacked up and down when being folded. The cross bar 10 is foldable for package with the vertical bar 20, or the cross bar 10 is foldable to individually pack.

Referring to FIG. 1 and FIG. 2, the top surface of the front section 12 is disposed with a convex block 18, the vertical bar 20 is connected between the convex blocks 18 of the two cross bars. The convex block 18 is Π shaped. The top surface of the cross bar 10 is disposed with a plurality of limit elements 40, the limit element 40 is a cup sleeve structure with a position hole, the end portion of the vertical bar 20 is bending downwardly to form an insert piece 21, the insert piece 21 is inserted to the position hole of the limit element 40.

Referring to FIGS. 1-6, the spring bed of the present invention further comprises a mattress 50, the mattress 50 comprises a plurality of elastic single bodies 52, two adjacent elastic single bodies 52 are connected by a connecting belt 54, the width of the connecting belt 54 is configured corresponding to the thickness of the elastic single body 52, the elastic single bodies are stacked when being folded.

The Second Embodiment

Figure 9:
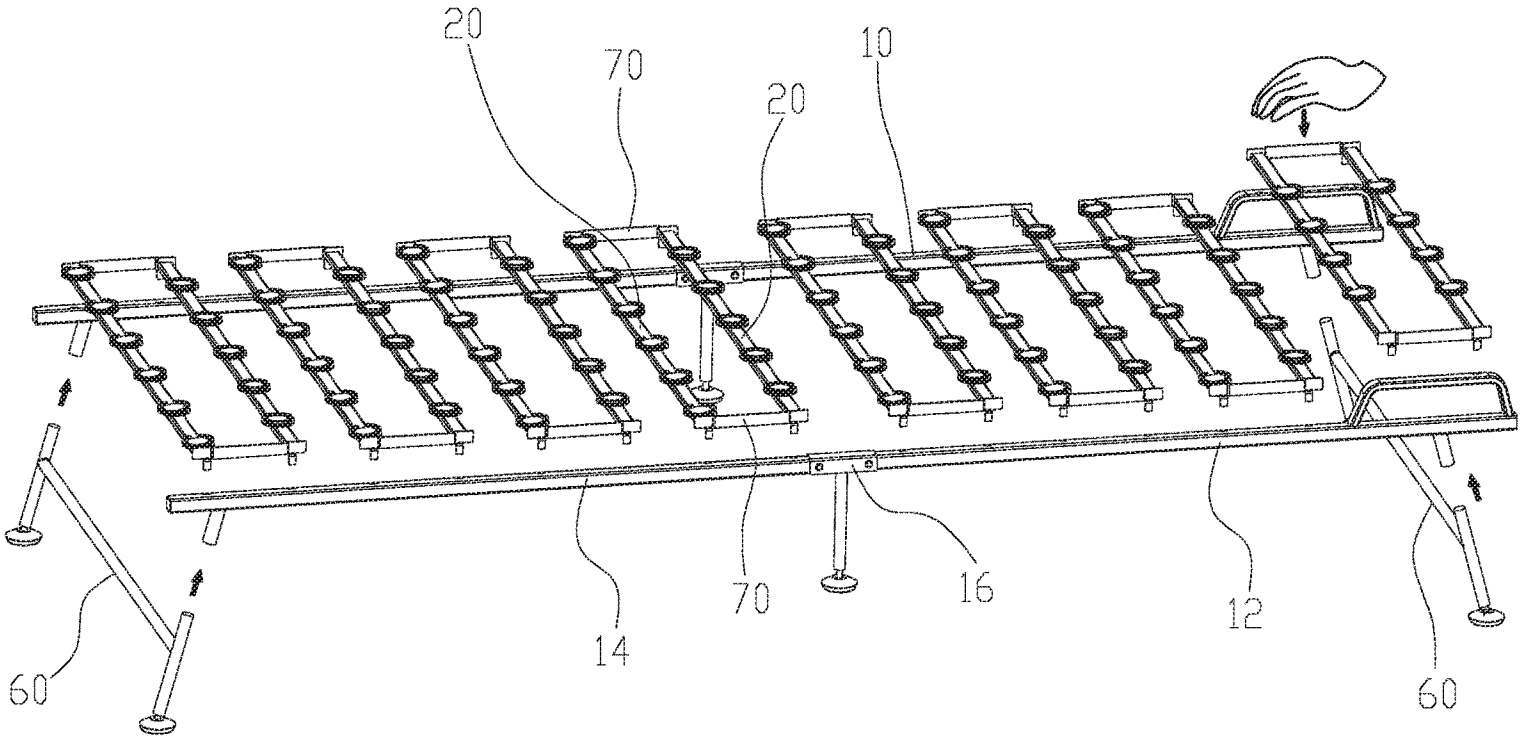
FIG. 9 illustrates a schematic diagram of a spring bed with quick assembly and disassembly of a second embodiment of the present invention.
Figure 10:
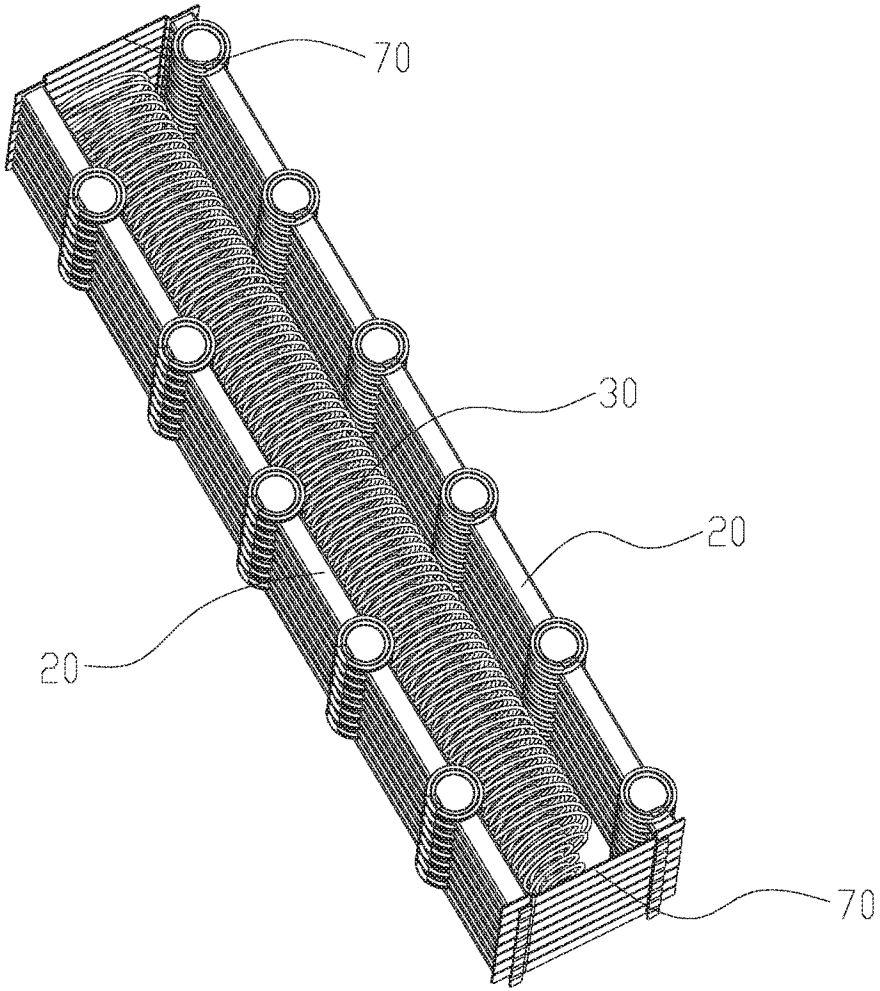
FIG. 10 illustrates a schematic diagram of the folded vertical bars and conical springs of the spring bed of FIG. 9.
Figure 11:
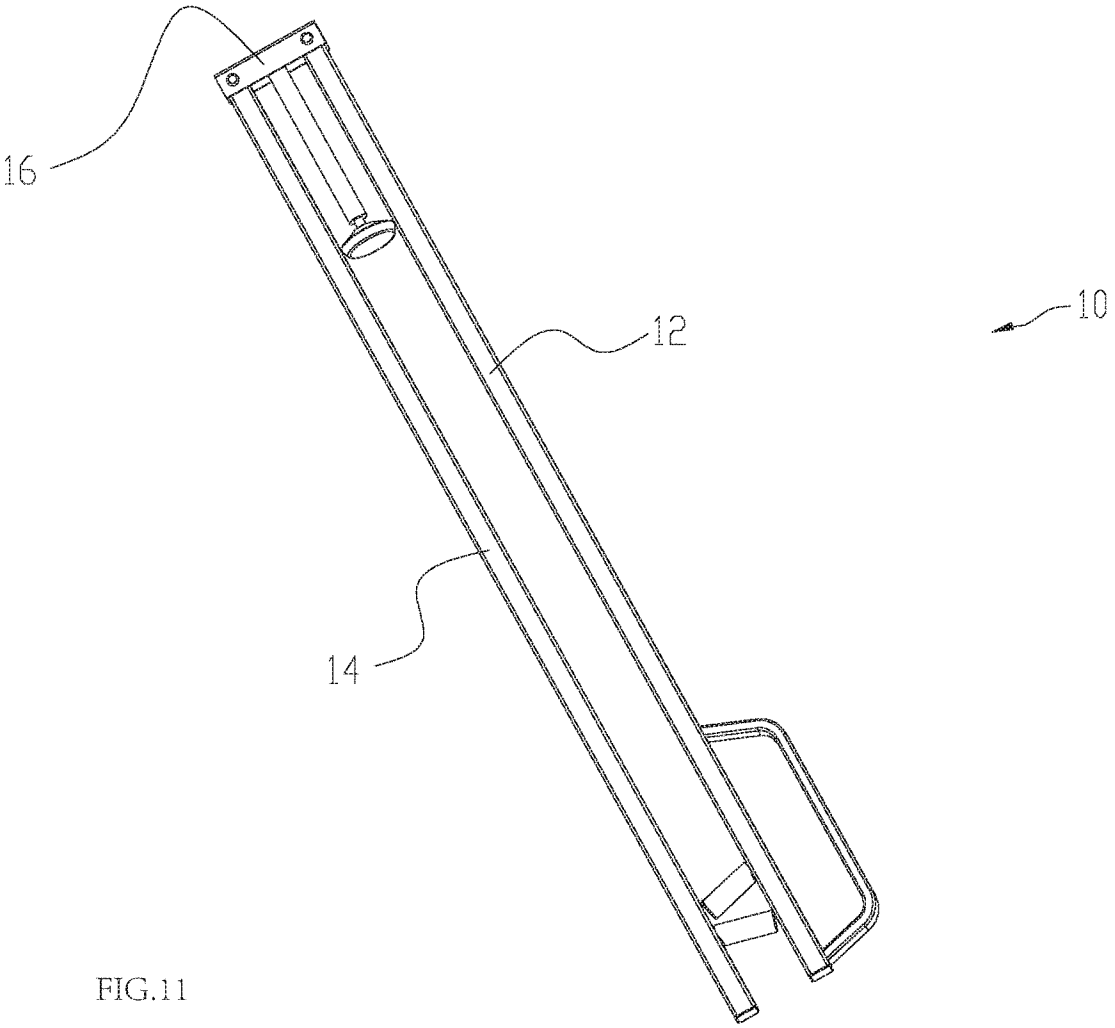
FIG. 11 illustrates a schematic diagram of a folded cross bar of the spring bed of FIG. 9.

Referring to FIGS. 9-11, the second embodiment differs from the first embodiment in that: the front section 12, the rear section 14 of the cross bar are pivoted to the central section 16, the folded cross bar 10 is Π shaped; two support legs 60 are further provided, two ends of the cross bar 10 are respectively supported by the support leg 60. the end portions at the same direction of the two vertical bars 20 are connected by a connecting element 70, two vertical bars 20 and two connecting elements 70 surround to form a rectangle structure. The rectangle structures are stacked together when being packed, the conical springs 30 are stacked together in the rectangle structure.

INDUSTRIAL APPLICABILITY

The present invention is provided that the spring structure is detachable, the connecting is simple that it can be done by hands. In addition, there are many kinds of combination, the springs and the vertical bar can be packed in connecting state or separated and individually packed. The assembly and disassembly are quick, the spring beds are convenient to carry and they also satisfy the needs of a travel bed.

The invention claimed is:

1. A spring bed with quick assembly and disassembly, comprising:
- two cross bars arranged in parallel,
- a plurality of vertical bars arranged in parallel with a space between each pair of vertical bars of the plurality of vertical bars,
- a plurality of springs, and
- at least four support legs, wherein:
  - a top surface of each of the two cross bars comprises a plurality of limit elements,
  - each of the plurality of limit elements has a cup sleeve structure with a position hole,
  - each of two end portions of each of the plurality of vertical bars bends downwardly to form an insert piece,
  - the insert piece is configured to be inserted into the position hole,
  - each of the plurality of vertical bars comprises a plurality of fixing bases spaced at intervals along a length direction of a corresponding one of the plurality of vertical bars,
  - each of the plurality of springs is detachably disposed on a corresponding one of the plurality of fixing bases,
  - a first end of each of the two cross bars is supported by a first support leg and a second support leg of the at least four support legs,
  - a second end of each of the two cross bars is supported by a third support leg and a fourth support leg of the at least four support legs, and
  - when the spring bed is packed, the plurality of springs disposed on two of the plurality of vertical bars are embedded together in a crossing way.

2. The spring bed with quick assembly and disassembly according to claim 1, wherein:
- each of the plurality of springs is a conical spring,
- an external surface of each of the plurality of fixing bases is disposed with a spiral groove corresponding to the conical spring,
- each of the plurality of fixing base is formed with a protruding edge on the spiral groove,
- the protruding edge is disposed with an opening connected to the spiral groove, and
- one end of the conical spring screws onto and unscrews out of the spiral groove through the opening.

3. The spring bed with quick assembly and disassembly according to claim 2, wherein:
- an external edge of the protruding edge turns down to form a flange.

4. The spring bed with quick assembly and disassembly according to claim 2, wherein:
- the conical spring has a first end having a first diameter and a second end having a second diameter smaller than the first diameter,
- the second end of the conical spring is connected to a corresponding one of the plurality of fixing bases, and
- the first end of the conical spring is a closed ring.

5. The spring bed with quick assembly and disassembly according to claim 1, wherein:

each of the two cross bars comprises a front section, a rear section and a central section connected to the front section and the rear section, the central section is rotatably or detachably connected to the front section, and the central section is rotatably or detachably connected to the rear section.

6. The spring bed with quick assembly and disassembly according to claim 5, wherein:

a sidewall of each of two ends of the central section respectively comprises an elastic block ball, a sidewall of the front section and a sidewall of the rear section are respectively disposed with a through hole, and the elastic block ball is configured to be embedded into the through hole.

7. The spring bed with quick assembly and disassembly according to claim 5, wherein:

the central section is respectively connected to the front section and the rear section by a hinge, and the front section and the rear section are configured to fold to two sides of the central section.

8. The spring bed with quick assembly and disassembly according to claim 5, wherein:

the central section is respectively rotatably riveted to the front section and the rear section, and the front section, the rear section and the central section are configured to be stacked up and down when folded.

9. The spring bed with quick assembly and disassembly according to claim 5, wherein:

the front section of each of the two cross bars comprises a convex block, and the plurality of vertical bars are connected between the convex blocks of the two cross bars.

10. The spring bed with quick assembly and disassembly according to claim 9, wherein:

the convex block is Π shaped.

11. The spring bed with quick assembly and disassembly according to claim 1, further comprising:

a mattress, wherein:

the mattress comprises a plurality of elastic single bodies, each of the plurality of elastic single bodies is connected to an adjacent one of the plurality of elastic single bodies by a connecting belt, and when the mattress is folded, the plurality of elastic single bodies are stacked.

12. The spring bed with quick assembly and disassembly according to claim 1, wherein:

the plurality of vertical bars comprises a first vertical bar and a second vertical bar adjacent to the first vertical bar, a first end of the first vertical bar is connected to a first end of the second vertical bar by a first connecting element, a second end of the first vertical bar is connected to a second end of the second vertical bar by a second connecting element, and the first vertical bar, the second vertical bar, and first connecting element, and the second connecting element are coupled together to define a rectangle structure.

13. A spring bed with quick assembly and disassembly, comprising:

two cross bars arranged parallel, a plurality of vertical bars arranged in parallel with a space between each pair of vertical bars of the plurality of vertical bars, a plurality of springs, and at least four support legs, wherein:

a top surface of each of the two cross bars comprises a plurality of limit elements, each of the plurality of limit elements has a cup sleeve structure with a position hole, each of two end portions of each of the plurality of vertical bars bends downwardly to form an insert piece, the insert piece is configured to be inserted into the position hole, each of the plurality of vertical bars comprises a plurality of fixing bases spaced at intervals along a length direction of a corresponding one of the plurality of vertical bars, each of the plurality of springs is detachably disposed on a corresponding one of the plurality of fixing bases, each of the two cross bars comprises a front section, a rear section and a central section connected to the front section and the rear section, the central section is rotatably or detachably connected to the front section, the central section is rotatably or detachably connected to the rear section, a first end of each of the two cross bars is supported by a first support leg and a second support leg of the at least four support legs, and a second end of each of the two cross bars is supported by a third support leg and a fourth support leg of the at least four support legs.

14. The spring bed with quick assembly and disassembly according to claim 13, wherein:

a sidewall of each of two ends of the central section respectively comprises an elastic block ball, a sidewall of the front section and a sidewall of the rear section are respectively disposed with a through hole, and the elastic block ball is configured to be embedded into the through hole.

15. The spring bed with quick assembly and disassembly according to claim 13, wherein:

the central section is respectively connected to the front section and the rear section by a hinge, and the front section and the rear section are configured to fold to two sides of the central section.

16. The spring bed with quick assembly and disassembly according to claim 13, wherein:

the central section is respectively rotatably riveted to the front section and the rear section, and the front section, the rear section and the central section are configured to be stacked up and down when folded.

17. The spring bed with quick assembly and disassembly according to claim 13, wherein:

the front section of each of the two cross bars comprises a convex block, the plurality of vertical bars are connected between the convex blocks of the two cross bars.

18. The spring bed with quick assembly and disassembly according to claim 13, wherein:

each of the plurality of springs is a conical spring, an external surface of each of the plurality of fixing bases is disposed with a spiral groove corresponding to the conical spring, each of the plurality of fixing base is formed with a protruding edge on the spiral groove, the protruding edge is disposed with an opening connected to the spiral groove, and one end of the conical spring screws onto and unscrews out of the spiral groove through the opening.

19. The spring bed with quick assembly and disassembly according to claim 18, wherein:

the conical spring has a first end having a first diameter and a second end having a second diameter smaller than the first diameter, the second end of the conical spring is connected to a corresponding one of the plurality of fixing bases, and the first end of the conical spring is a closed ring.

20. The spring bed with quick assembly and disassembly according to claim 13, wherein at least one of:

the intervals are equal-sized intervals, when the spring bed is packed, the plurality of springs disposed on two of the plurality of vertical bars are embedded together in a crossing way, or each of the plurality of springs are configured to be detached from a corresponding one of the plurality of fixing bases.

21. The spring bed with quick assembly and disassembly according to claim 13, further comprising:

a mattress, wherein:

the mattress comprises a plurality of elastic single bodies, each of the plurality of elastic single bodies is connected to an adjacent one of the plurality of elastic single bodies by a connecting belt, and when the mattress is folded, the plurality of elastic single bodies are stacked.

22. The spring bed with quick assembly and disassembly according to claim 13, wherein:

a middle portion of each of the plurality of vertical bars is concave and the plurality of fixing bases are disposed on the middle portion.

* * * * *